United States Patent [19]

Campoli et al.

[11] 4,187,783

[45] Feb. 12, 1980

[54] DISCARDING SABOT MUNITION

[75] Inventors: Ralph F. Campoli, Mine Hill; Elie L. Barrieres, Morris Plains; John W. Bannat, Lake Hopatcong, all of N.J.; Edwin G. Steiner, Jesup, Iowa; Thomas A. Lynch, Waterloo, Iowa; Gary M. Miller, Waterloo, Iowa

[73] Assignee: The United States of America as represented by the Secretary of the Army, Washington, D.C.

[21] Appl. No.: 885,715

[22] Filed: Mar. 13, 1978

[51] Int. Cl.[2] ..... F42B 13/16

[52] U.S. Cl. ..... 102/93

[58] Field of Search ..... 102/93, DIG. 7

[56] References Cited

U.S. PATENT DOCUMENTS

| | | | |
|---|---|---|---|
| 3,620,167 | 11/1971 | Romer et al. | 102/93 |
| 3,981,246 | 9/1976 | Luther et al. | 102/93 |
| 4,109,582 | 8/1978 | Haep et al. | 102/93 |
| 4,140,061 | 2/1979 | Campoli | 102/93 |

FOREIGN PATENT DOCUMENTS

| | | | |
|---|---|---|---|
| 2331158 | 1/1975 | Fed. Rep. of Germany | 102/93 |

*Primary Examiner*—Verlin R. Pendegrass

*Attorney, Agent, or Firm*—Nathan Edelberg; Robert P. Gibson; Max Yarmovsky

[57] ABSTRACT

A plurality of discarding type segmented sabots are peripherally disposed circumambient to the longitudinal axis of a subcaliber projectile to support the subcaliber projectile during launch. A prestressed notched bourrelet flange member screwedly attached to the forward sections of the sabot segments holds the sabot-projectile assembly together during launch. An aft bourrelet-obturator-slip ring assembly secures the rear sections of the sabot segments while transmitting only part of the rifling induced spin to the projectile. A self-adhering flexible base seal member is positioned in the aft end of the sabot segments to enhance efficient obturation of the propellant gases.

5 Claims, 4 Drawing Figures

DISCARDING SABOT MUNITION

GOVERNMENTAL INTEREST

The invention described herein was made in the course of a contract with the Government and may be manufactured, used and licensed by or for the Government for governmental purposes without the payment to us of any royalty thereon.

BACKGROUND OF THE INVENTION

Various means have been used in the prior art to allow a subcaliber projectile to be fired from a large bore gun. Such combinations are generally used in order to give a high density projectile maximum kinetic energy effect at impact. Increasing a projectile's terminal velocity generally improves the projectile's penetration capability. Prior art sabot designs utilized kinetic energy subcaliber penetrator rounds which frequently were of cup shape or ring type design. With the development of high length-to diameter (L/D), fin stabilized, high density kinetic-energy penetration "arrow" projectiles, it became obvious that the traditional cup or push type sabots designs were inadequate. It became necessary to develop ring or push-pull type sabots which wrapped around the projectile, partially pulling and partially pushing the projectile through the launch tube. One of the problems with fin-stabilized, "arrow" projectiles and prior art ring sabot combinations has been the destructive errosion effects caused by propellant gas leakage at the interfaces between the launch tube and sabot and between the sabot and the projectile. Another problem with the prior art ring sabot designs was that they frequently failed to prevent in-bore balloting, and failed to give clean and swift discard from the subcaliber projectile.

PRIOR ART STATEMENT

The applicant has reviewed the patent of Hans Werner Luther, U.S. Pat. No. 3,899,978 and found it of interest and partially pertinent to the present application. The present invention may be distinguished from the aforementioned reference in that the latter reference does not disclose a segmented drive cage held together in the front by a pre-stressed notched forward bourrelet, a self-adhering flexible base seal in contradistinction to a healing disk which must be screwed to the sabot segment, and a slip obturating band which combines a sealing function with a thrust function. The slip obturating band imparts only part of the spin caused by the gun rifling to the subcaliber projectile whereas a fixed non-slipping obturating band imparts the total spin force of the rifling.

SUMMARY OF THE INVENTION

The present invention relates to a sabot system for a kinetic energy subcaliber projectile which can be discarded cleanly and swiftly. The present device acts as a full caliber carrier capable of partially absorbing the propellant force while efficiently driving the subcaliber projectile out of the launch weapon at high velocity without causing in-bore balloting or undue spin to a fin stabilized projectile.

An object of the present invention is to provide a discarding sabot system for a kinetic energy type subcaliber projectile.

Another object of the present invention is to provide a discarding sabot system for a kinetic energy subcaliber projectile which can substantially absorb the propellant force while driving the subcaliber projectile out of the gun.

Another object of the present invention is to provide a discarding sabot system for a kinetic energy subcaliber projectile which transmits only part of the spin imparted by gun rifling to a fin stabilized subcaliber projectile.

Another object of the present invention is to provide a discarding sabot system for a kinetic energy subcaliber projectile which insures against in-bore projectile balloting.

A further object of the present invention is to provide a sabot system for a kinetic energy subcaliber projectile which discards swiftly and cleanly from the projectile once the assembly leaves the launch weapon.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
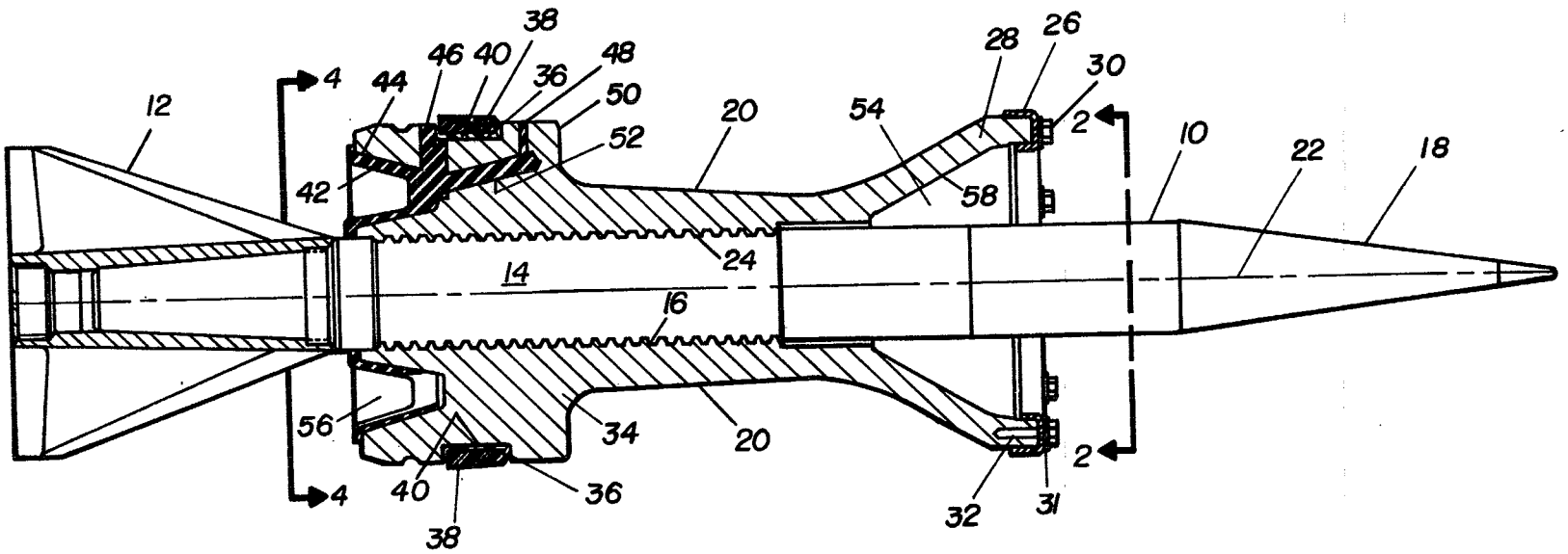
FIG. 1 is a partial diametral cross-sectional view of the sabot-projectile assembly.
Figure 4:
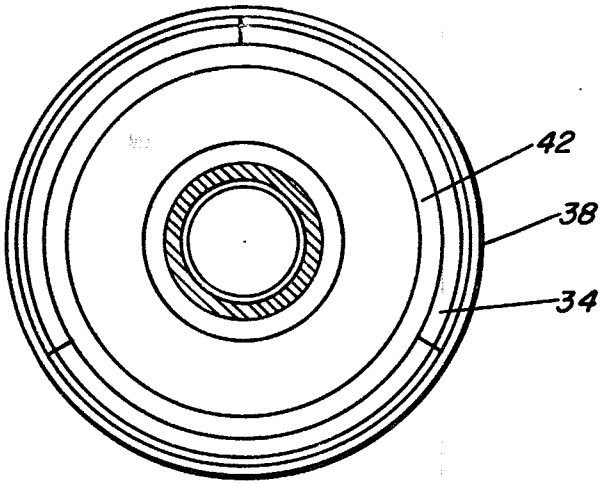
FIG. 4 is a partial cross-sectional view taken along line 4—4 of FIG. 1.
Figure 3:
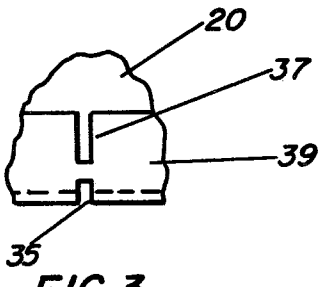
FIG. 3 is a partial cutaway view taken along line 3—3 of FIG. 2.
Figure 2:
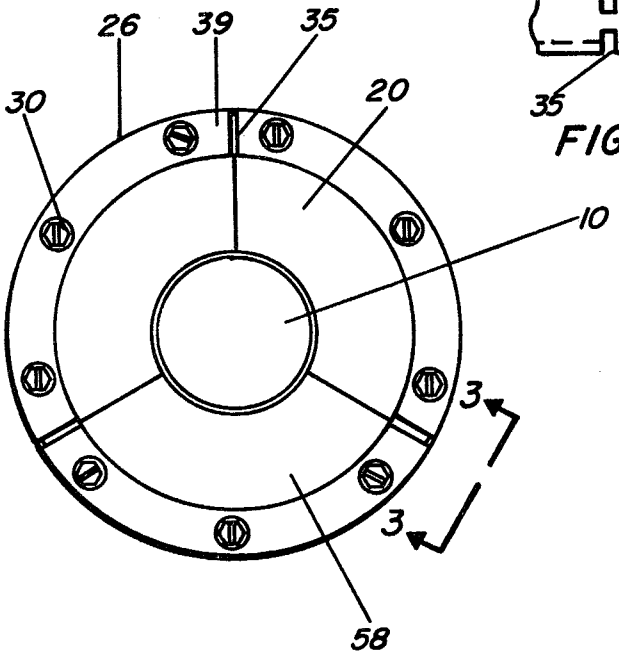
FIG. 2 is an end view of the sabot-prestressed notched bourrelet flange assembly taken along line 2—2 of FIG. 1.

Referring now to FIG. 1–4 the sabot-projectile assembly comprises an "arrow" shaped subcaliber projectile 10 having a tail end 12, a tubular shaped midsection 14 having a plurality of external concentric buttress grooves 16 disposed in the circumferential surface of midsection 14, a front ogive end 18, and a plurality of saddle shaped, undercut arcute sabot segments 20 that are disposed circumambient the longitudinal axis 22 of the projectile 10. In the preferred embodiment, there are three 120° sabot segments 20. Each sabot segment 20 has a tubular internally concentrically grooved surface 24 which meshes with the projectile buttress grooves 16. The buttress grooves 16 serve to transmit the driving force from the sabot segments 20 to the subcaliber projectile 10. The sabot sections 20 are machined from 7075–T6 aluminum extrusions, and are mated in sets of three for assembly to projectile bodies. The sabot segments 20 are held together as a 360° peripherally positioned assembly, prior to launch, by a stress notched breakaway forward bourrelet flange 26 made of steel. Bourrelet flange 26 has a "U" shaped cross-sectional area. Flange 26 is fixedly held to the sabot forward bourrelet lip ends 28 by a plurality of bolts 30. Bolts 30 pass through bourrelet flange holes 31 into longitudinally peripherally positioned sabot threaded bolt holes 32. A plurality of radially positioned equally spaced stress notches 35 and 37 are located on bourrelet flange front face 39 and flange rim 41 respectively, as shown on FIGS. 2 and 3, are designed to fail when a 400–600 pound radial load is exerted thereon. The "U" shaped cross-section of bourrelet flange 26 helps hold the sabot segments 20 secure to the subprojectile prior to and during launch. The bourrelet flange 26 fails at the oppositely positioned notches 35 and 37 upon exiting from the gun muzzle. Each sabot segment 20 has an aft bourrelet end 34 which has an aligned arcuate obturator groove 36 circumferentially disposed therein. An obturator band 38, made of such material as NYLON 101, is machined to shrink cool to a slip fit on top of a slip ring 40. Slip ring 40 is made of a polypropylene tube machined to a predetermined inside diameter, heated to 240° F. in an electric oven, then allowed to shrink cool upon the sabot segment assembly until it is tight. The outside geomentry of slip ring 40 is then machined to size. A self curing elastomer aft seal 42, made of such material as Silgan H-622 as manufactured by Silicone Corporation, adheres to the seal groove 44 of sabot segment aft face 44 and is disposed in between the joints of each peripherally positioned sabot segment 20 and fixedly held thereto by being extruded through seal holes 46 and 48 located in the aft bourrelet circumference 50. Seal holes 46 and 48 are interconnected and communicate with each other through elastomer passageway 52.

In operation when the sabot-projectile assembly is launched propellant gas is prevented from entering between the joints of the sabot segments 20 and the space between the sabot segments 20 and the projectile 10 by the self-curing urethane rubber aft seal 42. Aft seal 42 adheres to the aft face 44 of the sabot-projectile assembly and extends into the seal hole-passageway system 46, 48 and 52 respectively. When the propellant, not shown, is ignited high pressure gas generated in the launch tube, not shown, moves the sabot munition assembly forward. Only a small portion of the angular acceleration transmitted to the obturator 38 by rifling is transmitted to the subprojectile 10 because the polypropylene slip ring 40 beneath the obturator 38 allows the obturator 38 to slip thereon as the subprojectile 10 spins, owing to the relatively low coefficient of friction between the two mating parts. Forward and aft scoop areas 54 and 56, respectively, aid out-of-bore discard by entrapping air in the forward area and high pressure muzzle gas in the aft area. The forward scoop area 54 is created by conically shaped sections disposed on the inner surface of the sabot forward end 28. The forward bourrelet 26 breaks at a predetermined load when pressure is exerted thereon by sabot segments 20. Sabot segments are forced to leave the subprojectile 10 due to the combination of centrifugal and aerodynamic forces exerted thereon. The obturator-slip ring assembly fails in tension as a result of a combination of the muzzle gas and centrifugal forces. The materials of these two elements have been chosen to allow the assembly to function while in the launch tube but to fail as soon as they are subjected to tensile forces. The double bourrelet feature in the sabot segments 20 eliminates the need for bore-riding T-pads on the fin blades and thus help reduce aerodynamic drag on the subprojectile 10. The use of scooped forward and aft bourrelet 26 and 50, respectively, on sabot segments 20, positioned on opposite sides of the projectile center of gravity, in combination with flexible aft seal 42 and prestressed bourrelet 26, help to eliminate in-bore balloting and assist in the discard of the sabot segments 20 when the sabot-projectile assembly emerges from the muzzle of the gun.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A discarding sabot munition which comprises:

a subcaliber projectile having an ogive front end, a tail end and a tubularly shaped midsection, said midsection having a plurality of external concentric buttress grooves circumferentially disposed therein;

segmented sabot means, for acting as a full caliber carrier for said subcaliber projectile, for efficiently obturating propellant gases during projectile launch, for transmitting only part of the spin imparted by gun rifling, for preventing inbore balloting during launch and for discarding swiftly and cleanly from said subcaliber projectile after launch, which includes;

a plurality of saddle shaped undercut arcuate sabot segments peripherally positioned around the circumference of said tubularly shaped midsection of said projectile and circumambient to a longitudinal axis of said subcaliber projectile, each of said sabot segments having a tubular internally concentrically grooved surface therein meshing with said external concentric buttress grooves of said subcaliber projectile, each of said sabot section having a forward bourrelet end and an aft bourrelet end, said forward bourrelet end having a plurality of longitudinally peripherally positioned threaded bolt holes therein and a conically shaped section disposed on an inner surface of said forward bourrelet end, said aft bourrelet end of each sabot segment having an arcuate obturator groove circumferentially disposed therein, and an annular seal groove disposed in an aft face, said seal grooves forming a scoop area for said propellant gases, and a pair of seal holes communicating with said seal groove and said obturator groove by means of an elastomer passageway located therebetween;

a slip ring fixedly disposed in said arcuate obturator grooves;

an obturator band, rotatably disposed in said obturator groove of said aft bourrelet ends of said sabot segments, slidably fitting upon said slip ring;

compliant seal means operatively disposed in said annular seal groove intermediate said sabot segments for preventing propellant gases from entering the space between said sabot segments and between said sabot segments and said projectile; and forward bourrelet flange means fixedly attached to a lip of said forward bourrelet end for releaseably holding said sabot segments together during launch and for releasing said sabot segments from said projectile after launch.

2. A discarding sabot munition as recited in claim 1 wherein said slip ring is made of polyproplylene material.

3. A discarding sabot munition as recited in claim 2 wherein said obturator band is made of nylon material.

4. A discarding sabot munition as recited in claim 3 wherein said compliant seal means comprises a self curing, flexible, molded silicone elastomer disposed in said annular seal groove.

5. A discarding sabot munition as recited in claim 4 wherein said forward bourrelet flange means comprises an annular member having a "U" shaped cross-sectional area, a plurality of equally spaced stress notches located in the front face and rim of said flange, wherein said forward bourrelet flange means fails in tension at said stress notches after launch.

* * * * *